US007830221B2

(12) United States Patent
Merritt

(10) Patent No.: US 7,830,221 B2
(45) Date of Patent: Nov. 9, 2010

(54) COUPLING CANCELLATION SCHEME

(75) Inventor: Todd Merritt, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 285 days.

(21) Appl. No.: 12/020,289

(22) Filed: Jan. 25, 2008

(65) Prior Publication Data

US 2009/0189708 A1 Jul. 30, 2009

(51) Int. Cl.
*H01P 3/02* (2006.01)

(52) U.S. Cl. ..... 333/1; 333/33; 174/261

(58) Field of Classification Search ..... 333/1, 333/4, 5, 33; 174/250, 254, 255, 261
See application file for complete search history.

(56) References Cited

U.S. PATENT DOCUMENTS

| | | | | |
|---|---|---|---|---|
| 4,914,502 | A | 4/1990 | Lebowitz et al. | |
| 4,980,860 | A | 12/1990 | Houston et al. | |
| 5,097,441 | A | 3/1992 | Cho et al. | |
| 5,214,601 | A | 5/1993 | Hidaka et al. | |
| 5,334,802 | A | 8/1994 | Lamson | |
| 5,459,284 | A | 10/1995 | Bockelman et al. | |
| 5,475,643 | A | 12/1995 | Ohta | |
| 5,534,732 | A | 7/1996 | DeBrosse et al. | |
| 5,864,181 | A | 1/1999 | Keeth | |
| 5,994,766 | A | 11/1999 | Shenoy et al. | |
| 6,034,879 | A | 3/2000 | Min et al. | |
| 6,133,805 | A * | 10/2000 | Jain et al. | 333/1 |
| 6,188,598 | B1 | 2/2001 | Mueller et al. | |
| 6,300,846 | B1 * | 10/2001 | Brunker | 333/1 |
| 6,304,479 | B1 | 10/2001 | Vollrath et al. | |
| 6,327,170 | B1 | 12/2001 | Mueller et al. | |
| 6,504,246 | B2 | 1/2003 | Roth et al. | |
| 6,710,675 | B2 * | 3/2004 | Mikalauskas | 333/34 |

OTHER PUBLICATIONS

Wikipedia.org, Twisted Pair, http://en.wikipedia.org/wiki/Twisted-pair (Downloaded Oct. 17, 2007).

* cited by examiner

*Primary Examiner*—Stephen E Jones
(74) *Attorney, Agent, or Firm*—Knobbe, Martens, Olson, & Bear LLP

(57) ABSTRACT

Methods and apparatus are disclosed, such as those involving an interconnection layout for an integrated circuit (IC). One such layout includes a plurality of differential pairs of lines. Each differential pair has two lines including one or more parallel portions extending substantially parallel to each other. Each pair also includes a shield line. Each of the shield lines includes one or more parallel portions interposed between the parallel portions of one of the pairs of differential lines. One or more of the shield lines are electrically connected to a voltage reference, such as ground. This layout is believed to reduce or eliminate intra-pair coupling as well as inter-pair coupling.

24 Claims, 5 Drawing Sheets

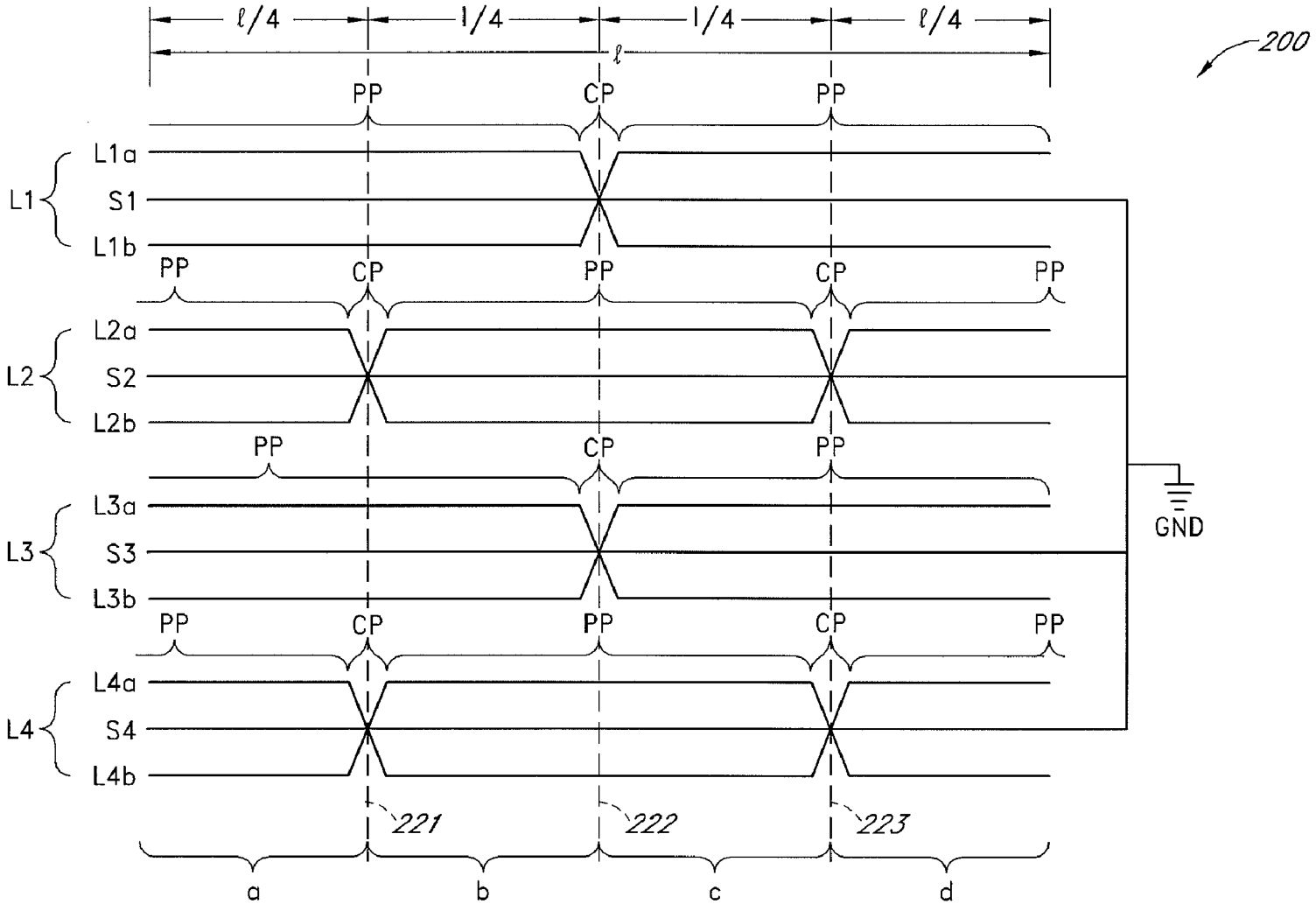
200
GND
ℓ/4
ℓ/4
ℓ/4
ℓ
PP
CP
PP
CP
PP
CP

COUPLING CANCELLATION SCHEME

BACKGROUND OF THE INVENTION

1. Field of the Invention

Embodiments of the invention relate to electronic devices, and more particularly, in one or more embodiments, to an interconnection layout for integrated circuits and/or printed circuit boards.

2. Description of the Related Art

In many applications in which electronic information is transmitted over a relatively long line, differential signaling has been widely used. Differential signaling is a method of transmitting information using two complementary signals sent on two separate lines. A differential circuit at a receiving end detects and compares the complementary signals, and determines logic changes based on the changes of one of the signals with reference to the other. Differential signaling is known to provide a relatively fast and accurate data transmission mechanism.

In differential signaling, however, a pair of lines carrying complementary signals can have electrical coupling or cross-talk between the pair of lines (intra-pair coupling) and/or with another neighboring pair of lines (inter-pair coupling). This electrical coupling adversely affects the accuracy of information transmitted over the lines. Thus, there is a need to provide a scheme to reduce or eliminate electrical coupling among separate pairs of differential lines.

FIG. 1 illustrates a conventional interconnection layout that can be used in an integrated circuit (IC) or a printed circuit (PC) board (also known as a printed wiring board) for differential signaling. The illustrated portion of the layout 100 can be repeated vertically and/or horizontally in the IC or PC board.

Typically, an interconnection layout for differential signaling can include a pair of lines that are "twisted" (wound), cross back and forth without twisting, or a combination of both. The illustrated portion includes first to fourth differential pairs L1-L4. Each of the differential pairs L1-L4 includes two lines carrying differential signals. In FIG. 1, the first pair L1 includes first and second lines L1*a*, L1*b*. The second pair L2 includes first and second lines L2*a*, L2*b*. The third pair L3 includes first and second lines L3*a*, L3*b*. The fourth pair L4 includes first and second lines L4*a*, L4*b*. The illustrated portion of the layout 100 includes four regions a, b, c, d from left to right. A boundary 121, 122, or 123 between neighboring ones of the regions a, b, c, d extends substantially perpendicular to a direction in which the pairs L1-L4 of lines extend. Each of the four regions a, b, c, d includes portions of all the pairs L1-L4 of lines.

Each of the pairs L1-L4 of lines includes crossing portions CP at an interval of ½ l. The crossing portions CP of the lines cross each other, for example, forming an "X" shape. The details of the crossing portions CP will be described later with reference to FIGS. 3A-3C and 4A-4C. Each of the pairs L1-L4 of lines includes parallel portions PP between neighboring ones of the crossing portions CP. The parallel portions PP of the lines extend substantially parallel to each other.

In FIG. 1, odd-numbered pairs L1, L3 have crossing portions CP adjacent to the parallel portions PP of neighboring even-numbered pairs L2, L4. Similarly, even-numbered pairs L2, L4 have crossing portions CP adjacent to the parallel portions PP of neighboring odd-numbered pairs L1, L3. The crossing portions CP of the first and third pairs L1, L3 are positioned at the boundary 122 between the regions b and c. Some of the crossing portions CP of the second and fourth pairs L2, L4 are positioned at the boundary 121 between the regions a and b while the other crossing portions CP of the second and fourth pairs L2, L4 are positioned at the boundary 123 between the regions c and d.

In the layout 100 of FIG. 1, the line L2*a* is adjacent to the line L1*b* in the region a, the line L3*a* in the region b, the line L3*b* in the region c, and the line L1*a* in the region d. The line L2*b* which pairs with the line L2*a* is adjacent to the line L3*a* in the region a, the line L1*b* in the region b, the line L1*a* in the region c, and the line L3*b* in the region d. Thus, within a length of l, both of the paired lines L2*a*, L2*b* experience electrical coupling with each of the lines L1*a*, L1*b*, L3*a*, L3*b* of the neighboring pairs L1, L3 by ¼ l. Because signals on the paired lines L1*a*, L1*b* are opposite in polarity to each other, coupling induced on the line L2*a* by these lines L1*a*, L1*b* are also opposite in polarity. Thus, coupling between the line L2*a* and the adjacent first pair L1 is canceled or reduced. Likewise, coupling between the line L2*a* and the other adjacent third pair L3 is canceled or reduced. Similarly, coupling between the line L2*b* and the first pair L1 and coupling between the line L2*b* and the third pair L3 are also canceled or reduced. In this manner, the layout 100 cancels or reduces inter-pair coupling.

BRIEF DESCRIPTION OF THE DRAWINGS

The embodiments will be better understood from the Detailed Description of Embodiments and from the appended drawings, which are meant to illustrate and not to limit the embodiments, and wherein:

FIG. 2 is a schematic diagram of one embodiment of a differential pair interconnection layout;

DETAILED DESCRIPTION OF EMBODIMENTS

The concepts and principles of the embodiments described below are presented herein in the context of an integrated circuit. A skilled artisan will, however, appreciate that the concepts and principles of the embodiments are applicable to other circuits, including, but not limited to, printed circuit (PC) boards, such as a board for a DIMM module or a memory module.

The layout 100 described above with reference to FIG. 1 cancels inter-pair coupling among separate differential pairs. However, the layout 100 does not cancel or reduce intra-pair coupling within a differential pair. Since signals of a differential pair are opposite in polarity to each other, intra-pair coupling can attenuate the signal levels. Thus, there is a need to provide a scheme that can reduce or eliminate intra-pair coupling as well as inter-pair coupling.

Figure 1:
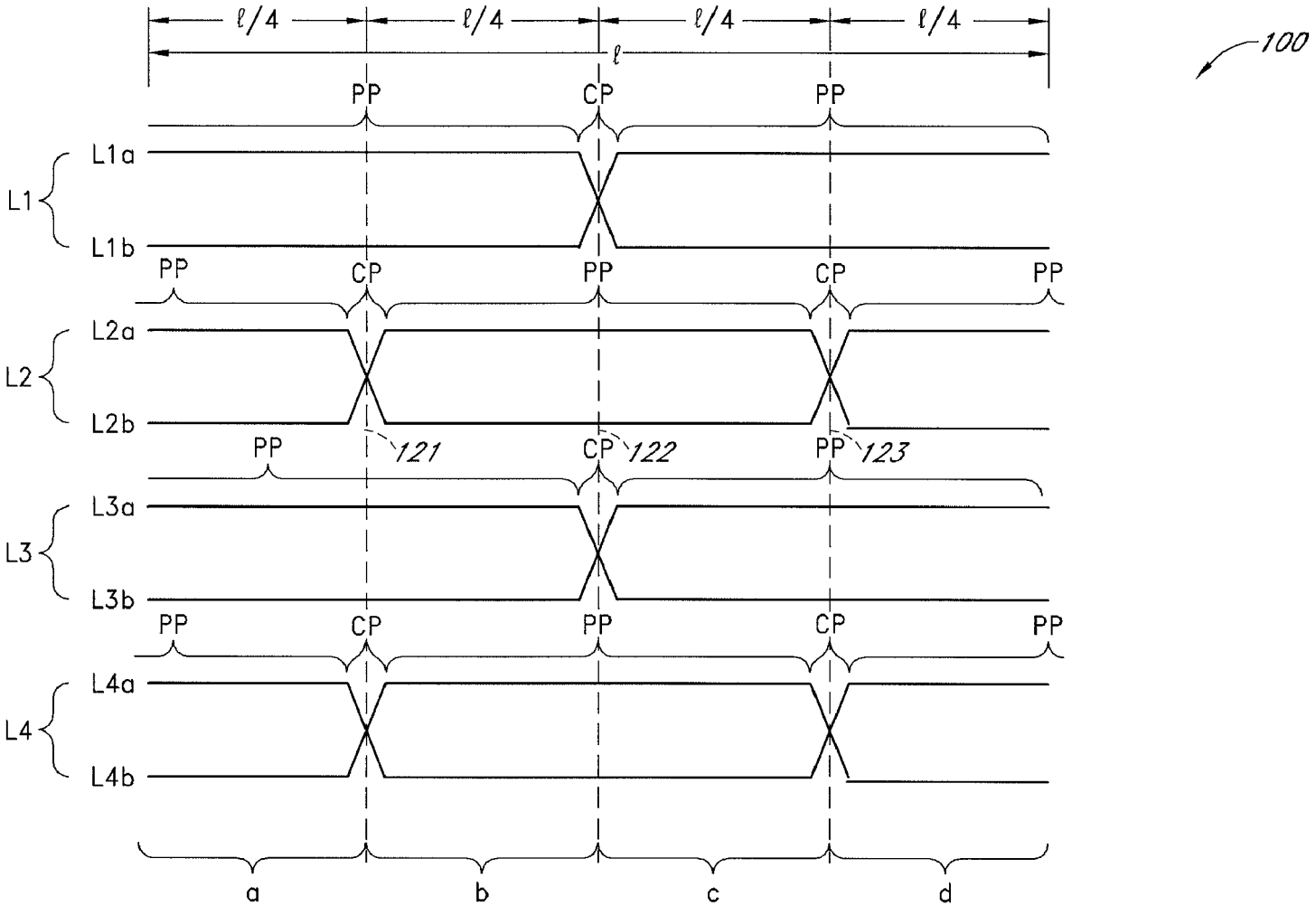
FIG. 1 (PRIOR ART)
FIG. 1 is a schematic diagram of a conventional differential pair interconnection layout for an integrated circuit (IC) or printed circuit (PC) board.

In one embodiment, an interconnection layout for differential signaling can have differential pairs similar to those described with reference to FIG. 1, and further includes a plurality of shield lines, each of which extends between paired differential lines. The shield lines run parallel to one or more parallel portions of the differential lines while crossing one or more crossing portions thereof. The pairs of differential lines should cancel or reduce inter-pair coupling therebetween while the shield lines should cancel or reduce intra-pair coupling.

Referring to FIG. 2, a differential signal interconnection layout 200 in an integrated circuit (IC) according to one embodiment will now be described. The illustrated portion of the layout 200 can be repeated vertically and/or horizontally in the IC. The illustrated portion includes first to fourth differential pairs L1-L4 of differential lines. Each of the differential pairs L1-L4 includes two lines and a conductive shield line S1, S2, S3, or S4 extending between the two lines.

The paired lines carry complementary signals which are opposite in polarity. In the illustrated embodiment, the first differential pair L1 includes lines L1*a*, L1*b*. The second differential pair L2 includes L2*a*, L2*b*. The third differential pair L3 includes L3*a*, L3*b*. The fourth differential pair L4 includes L4*a*, L4*b*. The illustrated portion of the layout 200 includes four regions a, b, c, d from left to right. A boundary 221, 222, or 223 between neighboring ones of the regions a, b, c, d extends substantially perpendicular to a direction in which the differential pairs L1-L4 of lines extend. Each of the four regions a, b, c, d includes portions of all the differential pairs L1-L4 of lines.

Each of the illustrated differential pairs L1-L4 includes crossing portions CP at an interval of ½ l. The crossing portions CP are located where the differential pair of lines cross each other. Each of the differential pairs L1-L4 includes parallel portions PP between neighboring two of the crossing portions CP. The parallel portions PP of the differential pair of lines extend substantially parallel to each other.

Odd-numbered differential pairs L1, L3 have crossing portions CP adjacent to the parallel portions PP of neighboring even-numbered differential pairs L2, L4. Similarly, even-numbered pairs L2, L4 have crossing portions CP adjacent to the parallel portions PP of neighboring odd-numbered differential pairs L1, L3. The crossing portions CP of the first and third differential pairs L1, L3 are positioned at the boundary 222 between the regions b and c. Some of the crossing portions CP of the second and fourth differential pairs L2, L4 are positioned at the boundary 221 between the regions a and b while the other crossing portions CP of the second and fourth differential pairs L2, L4 are positioned at the boundary 223 between the regions c and d.

The shield line S1, S2, S3, or S4 of each pair extends substantially parallel to the parallel portions PP of the paired lines. In the illustrated embodiment, the shield line S1, S2, S3, or S4 includes parallel portions interposed between the parallel portions PP of the paired lines. The parallel portions of the shield line S1, S2, S3, or S4 can be spaced substantially the same distance from the parallel portions PP of the paired lines. The shield line S1, S2, S3, or S4 also includes crossing portions which crosses both of the paired lines at the crossing portions CP.

Although not illustrated in FIG. 2, the shield lines S1-S4 are electrically insulated from the paired lines. The shield lines S1-S4 are connected to a voltage reference, such as a DC voltage source Vcc or ground GND. In certain embodiments, some of shield lines may be connected to a DC voltage source Vcc while other shield lines are connected to ground GND. A skilled artisan will, however, appreciate that the positions and configurations of the shield lines S1-S4 may be adjusted depending on the layout of the IC. In other embodiments, a single differential pair can include two or more shield lines which extend parallel to one another. In yet other embodiments, a single differential pair can include two or more shield lines, each of which extends between different parallel portions of the differential lines.

In the layout of FIG. 2, the line L2*a* is adjacent to the line L1*b* in the region a, the line L3*a* in the region b, the line L3*b* in the region c, and the line L1*a* in the region d. The line L2*b* which pairs with the line L2*a* is adjacent to the line L3*a* in the region a, the line L1*b* in the region b, the line L1*a* in the region c, and the line L3*b* in the region d. Thus, within a length of l, both of the paired lines L2*a*, L2*b* experience inter-pair electrical coupling with each of the lines L1*a*, L1*b*, L3*a*, L3*b* of the neighboring differential pairs L1, L3 by ¼ l. Because signals on the paired lines L1*a*, L1*b* are opposite in polarity, coupling induced on the line L2*a* by these lines L1*a*, L1*b* are also opposite in polarity. Thus, coupling between the line L2*a* and the adjacent first pair L1 should be canceled or reduced. Likewise, coupling between the line L2*a* and the other adjacent third pair L3 should be canceled or reduced. Similarly, coupling between the line L2*b* and the first pair L1 and coupling between the line L2*b* and the third pair L3 should also be canceled or reduced. In this manner, inter-pair coupling between pairs of differential lines should be reduced and canceled.

In addition, the layout 200 can be further configured to cancel or reduce intra-pair coupling. For example, in the second differential pair L2 of lines L2*a*, L2*b*, the first line L2*a* experiences coupling with the shield line S2 and the second line L2*b* also experiences coupling with the shield line S2. Because a signal on the first line L2*a* is opposite in polarity from a signal on the second line L2*b*, the coupling between the line L2*a* and the shield line S2 is opposite in polarity from the coupling between the line L2*b* and the shield line S2. Thus, the couplings should be reduced or canceled. Thus, intra-pair coupling between a differential pair of lines should be reduced or canceled.

Figure 3A:
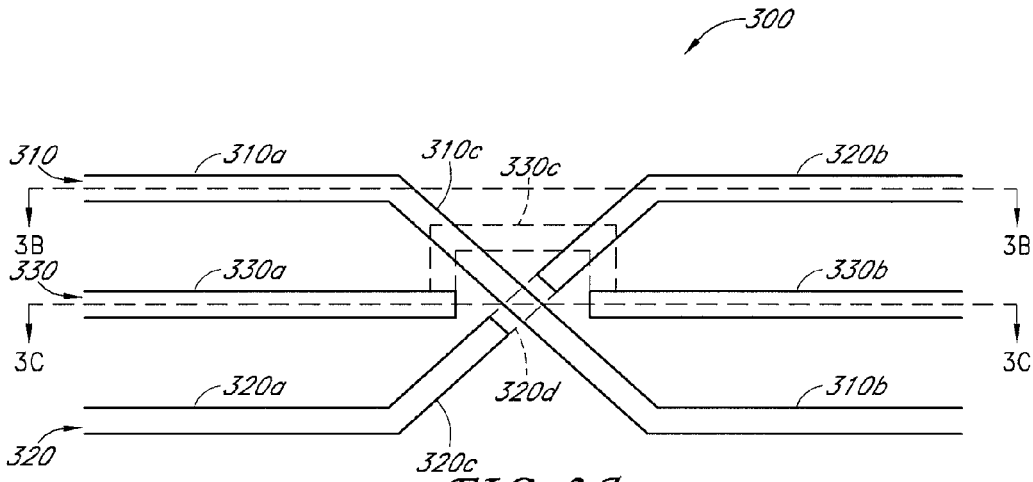
FIG. 3A is a top plan view of one embodiment of a differential pair interconnection layout.
Figure 3B:
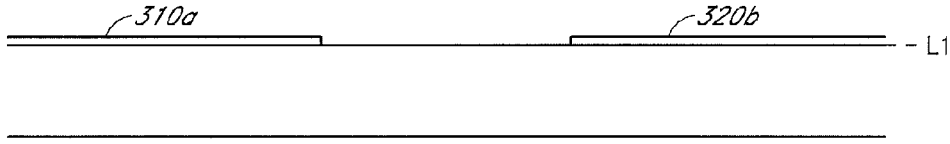
FIG. 3B is a cross-section of the differential pair interconnection layout of FIG. 3A, taken along lines 3B-3B.
Figure 3C:
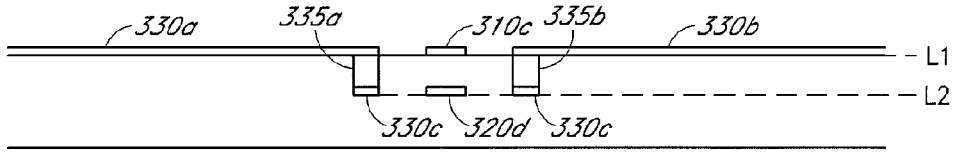
FIG. 3C is a cross-section of the differential pair interconnection layout of FIG. 3A, taken along lines 3C-3C.

Referring to FIGS. 3A-3C, an example of a structure of an interconnection layout according to one embodiment will be now described. The illustrated interconnection layout 300 can be implemented with 2 metal layers (L1, L2) and includes a differential pair and a shield line 330 formed in metallization layers over a silicon substrate assembly. The differential pair includes a first line 310 and a second line 320. The first and second lines 310, 320 and the shield line 330 are insulated from one another with an insulating material.

The first line 310 includes parallel portions 310*a*, 310*b* and a crossing portion 310*c*. In the illustrated embodiment, the parallel portions 310*a*, 310*b* and the crossing portion 310*c* are positioned at a first level L1 (FIG. 3B).

The second line 320 includes parallel portions 320*a*, 320*b* and a crossing portion 320*c*. In the illustrated embodiment, the parallel portions 320*a*, 320*b* and parts of the crossing portion 320*c* extending from the parallel portions 320*a*, 320*b* are positioned at the first level L1. The crossing portion 320*c* also includes a connecting line 320*d* at a second level L2 lower than the first level L1 (FIG. 3C). The crossing portion 320*c* further includes interconnects, such as plugs/vias, (not shown) to electrically connect the connecting line 320*d* to the parts of the crossing portions 320 at the first level L1. The connecting line 320*d* provides electrical connection between the parts of the crossing portions 320*c* at the first level L1 while being insulated from the first line 310.

The shield line 330 includes parallel portions 330*a*, 330*b* and a crossing portion 330*c*. The parallel portions 330*a*, 330*b* are positioned at the first level L1 (FIG. 3C) while the crossing portion 330*c* is positioned at the second level L2 (FIG. 3C). The crossing portion 330*c* of the shield line 330 is laterally spaced apart from the connecting line 320*d* of the second line 320 at the second level L2. The shield line 330 further includes interconnect vias 335*a*, 335*b* to electrically connect the crossing portion 330*c* to the parallel portions 330*a*, 330*b*. The crossing portion 330*c* provides electrical connection between the parallel portions 330*a*, 330*b* while being insulated from the first and second lines 310, 320.

Figure 4A:
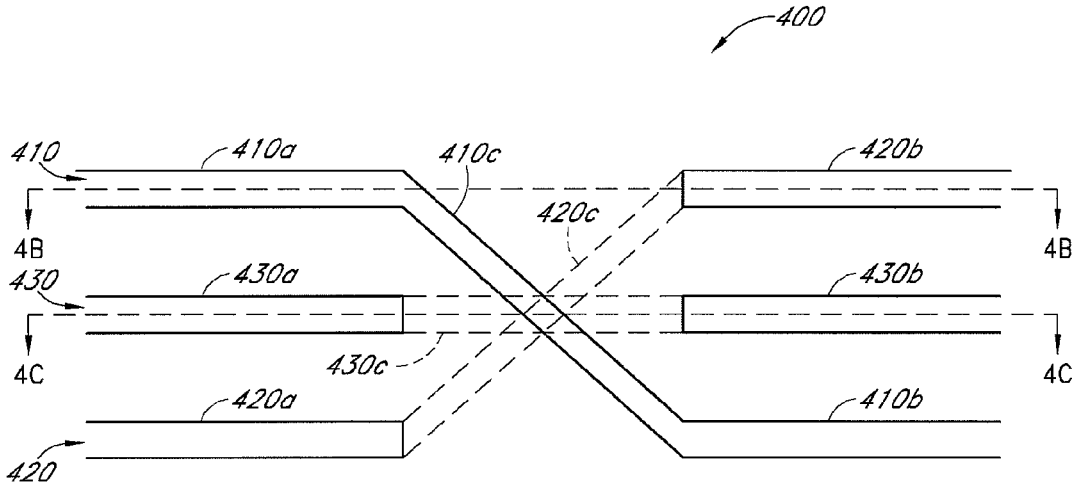
FIG. 4A is a top plan view of another embodiment of a differential pair interconnection layout.
Figure 4B:
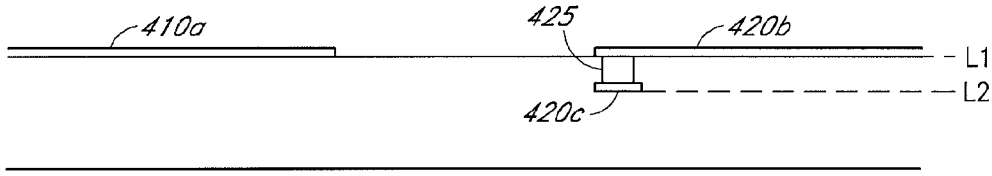
FIG. 4B is a cross-section of the differential pair interconnection layout of FIG. 4A, taken along lines 4B-4B.
Figure 4C:
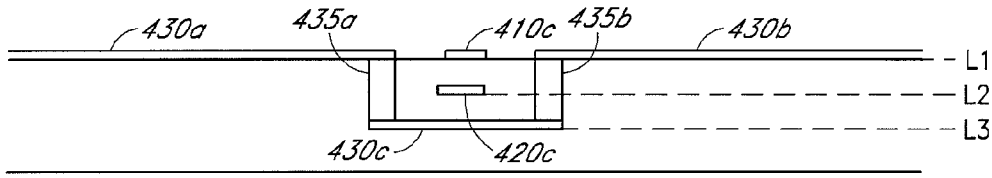
FIG. 4C is a cross-section of the differential pair interconnection layout of FIG. 4A, taken along lines 4C-4C.

Referring to FIGS. 4A-4C, the structure of another example of an interconnection layout will be now described. The illustrated interconnection layout 400 can be implemented with 3 metal layers (L1, L2, L3) and includes a differential pair and a shield line 430. The differential pair includes a first line 410 and a second line 420. The first and second lines 410, 420 and the shield line 430 are insulated from one another with an insulating material.

The first line 410 includes parallel portions 410*a*, 410*b* and a crossing portion 410*c*. In the illustrated embodiment, the parallel portions 410*a*, 410*b* and the crossing portion 410*c* are positioned at a first level L1 (FIG. 4B).

The second line 420 includes parallel portions 420*a*, 420*b* and a crossing portion 420*c*. In the illustrated embodiment, the parallel portions 420*a*, 420*b* are positioned at the first level L1 while the crossing portion 420*c* is positioned at a second level L2 lower than the first level L1 (FIGS. 4B and 4C). The second line 420 further includes interconnect vias 425 to electrically connect the crossing portion 420*c* to the parallel portions 420*a*, 420*b* at the first level L1. The crossing portion 420*c* provides electrical connection between the parallel portions 420*a*, 420*b* while being insulated from the first line 410.

The shield line 430 includes parallel portions 430*a*, 430*b* and a crossing portion 430*c*. The parallel portions 430*a*, 430*b* are positioned at the first level L1 (FIG. 4C) while the crossing portion 430*c* is positioned at a third level L3 lower than the second level L2 (FIG. 4C). The shield line 430 further includes interconnect plugs/vias 435*a*, 435*b* to electrically connect the crossing portion 430*c* to the parallel portions 430*a*, 430*b*. The crossing portion 430*c* provides electrical connection between the parallel portions 430*a*, 430*b* while being insulated from the first and second lines 410, 420.

A skilled artisan will appreciate that any suitable configurations of a differential pair and a shield line can be used to provide the interconnection layout described above. In certain embodiments in which the interconnection layout is used in a printed circuit board, the structures described above with respect to FIG. 3A-3C or 4A-4C can also be used or modified, depending on the circuit board configuration.

Figure 5:
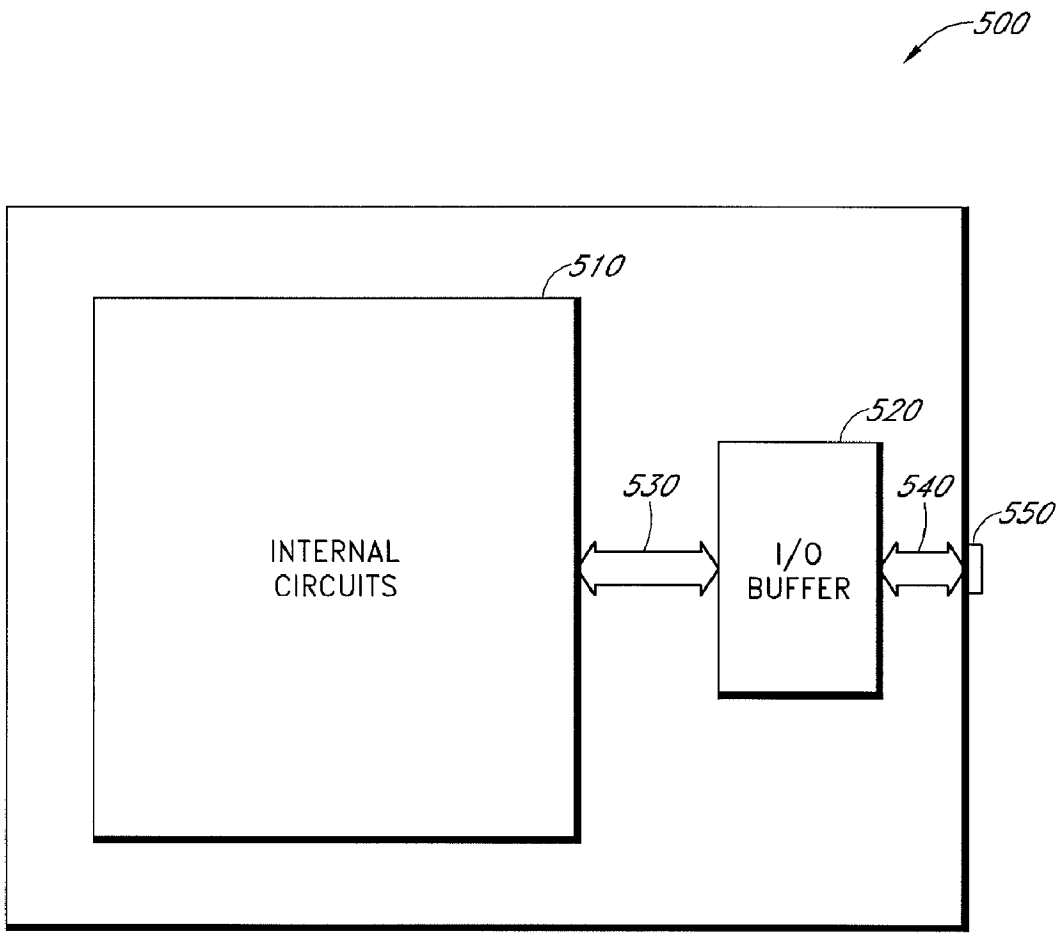
FIG. 5 is a schematic block diagram of one embodiment of an electronic device including the differential pair interconnection layout of FIG. 2.

Referring to FIG. 5, one embodiment of an electronic device including the differential line layout of FIG. 2 will now be described. The illustrated electronic device 500 includes internal circuits 510, an input/output (I/O) buffer 520, an interconnecting bus 530, an I/O bus 540, and an I/O port 550.

The internal circuits 510 may include integrated circuits, including, but not limited to, at least one of a processor and a memory cell array. The interconnecting bus 530 electrically connects the internal circuits to the I/O buffer 520. The I/O buffer 520 temporarily stores data being inputted to or being outputted from the internal circuits 510. The I/O bus 540 electrically connects the I/O buffer 520 to the I/O port 550.

In one embodiment, the interconnecting bus 530 may include a plurality of pairs of differential lines with the layout described above in connection with FIG. 2. A skilled artisan will appreciate that the layout can also be used in other portions of the electronic device (e.g., printed circuit boards) where differential lines are used.

The differential line layouts of the embodiments described above can apply to various electronic devices. Examples of the electronic devices can include, but are not limited to, consumer electronic products, electronic circuits, electronic circuit components, parts of the consumer electronic products, electronic test equipments, etc. Examples of the electronic devices can also include memory chips, memory modules, receiver circuits of optical networks or other communication networks, disk driver circuits, and serializer/deserializer (SerDes). The consumer electronic products can include, but are not limited to, a mobile phone, a telephone, a television, a computer monitor, a computer, a hand-held computer, a personal digital assistant (PDA), a microwave, a refrigerator, a stereo system, a cassette recorder or player, a DVD player, a CD player, a VCR, an MP3 player, a radio, a camcorder, a camera, a digital camera, a portable memory chip, a washer, a dryer, a washer/dryer, a copier, a facsimile machine, a scanner, a multi functional peripheral device, a wrist watch, a clock, etc. Further, the electronic device can include unfinished products.

In the embodiments described above, the differential signal interconnection layout should reduce or eliminate intra-pair coupling as well as inter-pair coupling. Because each of the shield lines is positioned between a pair of differential lines, the layout can be implemented without sacrificing a substantial space in the IC.

One embodiment is an apparatus including a first pair of electrically conductive lines insulated from each other. The first pair of lines includes: one or more crossing portions crossing each other; and one or more parallel portions extending on the same plane substantially parallel to each other. The parallel portions alternate with the crossing portions. The apparatus further includes an electrically conductive shield line connected to a voltage reference and electrically insulated from the first pair of lines. The shield line includes a first portion disposed between the parallel portions of the first pair of lines. The first portion of the shield line extends substantially parallel to the parallel portions of the first pair of lines.

Another embodiment is an apparatus including a plurality of differential pairs of lines. Each pair includes two lines including one or more parallel portions extending substantially parallel to each other. The apparatus further includes a plurality of shield lines. Each of the shield lines includes one or more parallel portions interposed between the parallel portions of a respective one of the differential pairs. One or more of the shield lines are electrically connected to a voltage reference.

Yet another embodiment is a method of forming an interconnection layout. The method includes forming a first pair of electrically conductive lines electrically insulated from each other on a substrate. The first pair of lines includes: one or more crossing portions crossing each other; and one or more parallel portions extending on the same plane substantially parallel to each other. The parallel portions alternate with the crossing portions. The method further includes forming an electrically conductive shield line on the substrate. The shield line is connected to a voltage reference and electrically insulated from the first pair of lines. The shield line includes a first portion disposed between the parallel portions of the first pair of lines. The first portion of the shield line extends substantially parallel to the parallel portions of the first pair of lines.

Although this invention has been described in terms of certain embodiments, other embodiments that are apparent to those of ordinary skill in the art, including embodiments that do not provide all of the features and advantages set forth herein, are also within the scope of this invention. Moreover, the various embodiments described above can be combined to provide further embodiments. In addition, certain features shown in the context of one embodiment can be incorporated into other embodiments as well. Accordingly, the scope of the present invention is defined only by reference to the appended claims.

I claim:

1. An apparatus comprising:

a first pair of electrically conductive lines insulated from each other, the first pair of lines including:

one or more crossing portions in which the lines cross each other; and two or more parallel portions in which the lines extend substantially parallel to each other, the parallel portions alternating with each of the crossing portions, wherein the lines in the parallel portions are on the same plane; and an electrically conductive shield line connected to a voltage reference and electrically insulated from the first pair of lines, the shield line comprising a first portion disposed between the parallel portions of the first pair of lines, the first portion of the shield line extending substantially parallel to the parallel portions of the first pair of lines.

2. The apparatus of claim 1, wherein the voltage reference comprises ground.

3. The apparatus of claim 1, wherein the voltage reference comprises a DC voltage source.

4. The apparatus of claim 1, wherein the shield line further comprises a second portion crossing one of the crossing portions.

5. The apparatus of claim 1, wherein the first portion of the shield line is spaced substantially the same distance from the parallel portions of the first pair of lines.

6. The apparatus of claim 1, wherein the first pair of lines are configured to carry differential signals.

7. The apparatus of claim 1, wherein the apparatus comprises an integrated circuit (IC).

8. The apparatus of claim 1, further comprising a first circuit and a second circuit, wherein the first pair of electrically conductive lines are configured to carry differential signals from the first circuit to the second circuit.

9. The apparatus of claim 8, wherein the first circuit comprises an array of memory cells, wherein the second circuit comprises an input/output buffer.

10. The apparatus of claim 1, further comprising a second pair of electrically conductive lines electrically insulated from each other, the second pair of lines including:

one or more crossing portions crossing each other; and one or more parallel portions extending on the same plane substantially parallel to each other and generally parallel to the parallel portions of the first pair of lines, wherein the crossing portions of the second pair are adjacent to the parallel portions of the first pair, wherein the parallel portions of the second pair are adjacent to the crossing portions of the first pair.

11. The apparatus of claim 10, further comprising a second electrically conductive shield line connected to the voltage reference and electrically insulated from the second pair of lines, the second shield line comprising a first portion interposed between the parallel portions of the second pair of lines, the first portion of the second shield line extending substantially parallel to the parallel portions of the second pair of lines.

12. The apparatus of claim 10, further comprising a third pair of electrically conductive lines electrically insulated from each other, the third pair of lines positioned on the opposite side of the first pair of lines from the second pair of lines, the third pair of lines including:

one or more crossing portions crossing each other; and one or more parallel portions extending substantially parallel to each other and generally parallel to the parallel portions of the first pair of lines, wherein the crossing portions of the third pair are adjacent to the parallel portions of the first pair, wherein the parallel portions of the third pair are adjacent to the crossing portions of the first pair.

13. The apparatus of claim 12, further comprising a third electrically conductive shield line electrically connected to the voltage reference and electrically insulated from the third pair of lines, the third shield line comprising a first portion interposed between the parallel portions of the third pair of lines, the first portion of the third shield line extending substantially parallel to the parallel portions of the third pair of lines.

14. An apparatus comprising:

a plurality of differential pairs of lines, each pair comprising two lines comprising two or more parallel portions in which the two lines extend substantially parallel to each other on the same plane, and crossing portions in which the two lines cross each other; and a plurality of shield lines, each of the shield lines comprising one or more parallel portions in which the shield line is interposed between the two lines in the parallel portions of a respective one of the differential pairs, one or more of the shield lines being electrically connected to a voltage reference, wherein each of the shield lines further comprises one or more crossing portions, in each of which the shield line crosses both of the two lines on a plane different from the plane on which the two lines extend substantially parallel to each other.

15. The apparatus of claim 14, wherein the crossing portions of one of the pairs are adjacent to the parallel portions of neighboring ones of the pairs, wherein the parallel portions of the one of the pairs are adjacent to the crossing portions of the neighboring ones of the pairs.

16. The apparatus of claim 14, wherein two or more of the shield lines are electrically connected to one another.

17. The apparatus of claim 14, wherein the parallel portions of the two lines of each pair and the parallel portions of the shield line between the two lines are at a first vertical level, wherein parts of the crossing portions of the shield lines are at a second vertical level different from the first vertical level, wherein parts of the crossing portions of the two lines are at the second vertical level.

18. The apparatus of claim 14, wherein the parallel portions of the two lines of each pair and the parallel portions of the shield line between the two lines are at a first vertical level, wherein parts of the crossing portions of the shield lines are at a second vertical level different from the first vertical level, wherein parts of the crossing portions of the two lines are at a third vertical level different from the first and second vertical levels.

19. The apparatus of claim 14, wherein each of the crossing portions of the two lines of each pair comprises a first conductive line and a second conductive line, wherein the entirety of the first conductive line is at a first vertical level, wherein a part of the second conductive line is at a second vertical level different from the first vertical level.

20. The apparatus of claim 14, wherein the one or more parallel portions of each of the shield lines extend substantially parallel to the parallel portions of each pair.

21. The apparatus of claim 20, wherein the one or more parallel portions of each of the shield lines are spaced substantially the same distance from the parallel portions of a respective one of the pairs.

22. A method of forming an interconnection layout, the method comprising:

forming a first pair of electrically conductive lines electrically insulated from each other on a substrate, the first pair of lines including:

one or more crossing portions in which the lines cross each other; and two or more parallel portions in which the lines extend substantially parallel to each other, the parallel portions alternating with each of the crossing portions, wherein the lines in the parallel portions are on the same plane; and forming an electrically conductive shield line on the substrate, the shield line being connected to a voltage reference and electrically insulated from the first pair of lines, the shield line comprising a first portion disposed between the parallel portions of the first pair of lines, the first portion of the shield line extending substantially parallel to the parallel portions of the first pair of lines.

23. The method of claim 22, wherein each of the pair of lines further comprises one or more crossing portions crossing each other, wherein the shield line crosses the one or more crossing portions.

24. The method of claim 22, wherein the first pair is configured to carry differential signals.

* * * * *